US005849684A

United States Patent [19]

Donoghue et al.

[11] Patent Number: 5,849,684

[45] Date of Patent: Dec. 15, 1998

[54] DETERGENT ADDITIVES COMPRISING DYE TRANSFER INHIBITORS, AND PROCESS FOR MAKING THEM

[75] Inventors: Scott John Donoghue, Brussels; Koen Mariette Albert Schamp, Aalter, both of Belgium

[73] Assignee: The Procter & Gamble Company, Cincinnati, Ohio

[21] Appl. No.: 727,558

[22] PCT Filed: Apr. 3, 1995

[86] PCT No.: PCT/US95/04210

§ 371 Date: Oct. 15, 1996

§ 102(e) Date: Oct. 15, 1996

[87] PCT Pub. No.: WO95/28462

PCT Pub. Date: Oct. 26, 1995

[30] Foreign Application Priority Data

Apr. 14, 1994 [EP] European Pat. Off. ..... 94302676

[51] Int. Cl.[6] ..... C11D 7/60; C11D 3/37; C11D 11/00; C11D 17/06

[52] U.S. Cl. ..... 510/513; 510/349; 510/360; 510/438; 510/444; 510/475; 510/499; 510/500; 510/503; 510/531; 510/532; 510/533

[58] Field of Search ..... 510/475, 360, 510/438, 442, 443, 444, 349, 499, 500, 503, 513, 531, 532, 533

[56] References Cited

U.S. PATENT DOCUMENTS

| | | | |
|---|---|---|---|
| 4,605,509 | 8/1986 | Corkill et al. | 510/352 |
| 5,133,924 | 7/1992 | Appel et al. | 264/342 R |
| 5,431,857 | 7/1995 | Capeci | 510/352 |
| 5,451,341 | 9/1995 | White | 510/299 |
| 5,466,802 | 11/1995 | Panandiker et al. | 510/320 |
| 5,478,502 | 12/1995 | Swift | 510/350 |
| 5,478,503 | 12/1995 | Swift | 510/350 |
| 5,622,646 | 4/1997 | Scialla et al. | 252/186.33 |

FOREIGN PATENT DOCUMENTS

| | | |
|---|---|---|
| 0 582 478 | 2/1994 | European Pat. Off. . |
| 94/02576 | 2/1994 | WIPO . |

*Primary Examiner*—Ardith Hertzog
*Attorney, Agent, or Firm*—Jacobus C. Rasser; Ken K. Patel; D. Mitchell Goodrich

[57] ABSTRACT

Free-flowing powder detergent additives particularly useful as agglomerates to be added during the manufacture of detergents suitable for washing colored fabric and which contain certain detergent builders, dye transfer inhibiting polymers and optionally a detersive surfactant. Also disclosed are methods for preparing a premix of specific hygroscopic dye transfer inhibitors for use in a spray-drying powder formation process. The compositions utilized for such premixes include a powder builder such as zeolite and the dye transfer inhibition polymers polyamine N-oxide, and copolymers of N-vinylpyrrolidone and N-vinylimidazole.

7 Claims, No Drawings

DETERGENT ADDITIVES COMPRISING DYE TRANSFER INHIBITORS, AND PROCESS FOR MAKING THEM

The present invention relates to a free-flowing powder having a high bulk density comprising certain polymers useful as dye transfer inhibitors in the cleaning of, for example, laundry items.

The invention also relates to a process for making the free-flowing powder.

The use of various polymers as dye transfer inhibitors in detergent compositions has been described in the prior art. One method of incorporating the polymers into granular detergent compositions has been to dry mix powdered polymers with other granular components.

However it has been noted that there is a problem of lumping and caking of granular detergents associated with using hygroscopic polymer powders in this way. Furthermore there are difficulties of bulk handling the those powders.

U.S. Pat. No. 5,259,994 has addressed these problems by mixing polyvinyl pyrollidone with zeolite, a hydrating salt (e.g. carbonate) and a binding agent to prepare a free-flowing detergent additive. However, the small, anhydrous additive readily absorbs water upon contact. The resulting gel can have an adverse effect on product dispensing.

U.S. Pat. No. 4,414,130 discloses a "readily disintegrable, insoluble, detergent builder particulate agglomerate comprising [aluminosilicate] held together by a water soluble binder." One such binder which is mentioned is Polyclar®, a PVP supplied by GAF. Methods of manufacturing agglomerates include the use of a fine spray of water to promote adhesion. Example 2(B) discloses a solution of polyvinyl pyrollidone and polyvinyl alcohol which is agglomerated with zeolite. This patent is not, however, concerned with the problems of formulating and processing dye transfer inhibiting agents.

Although polyvinyl pyrrolidone is useful as a dye transfer inhibitor, other polymers are being sought which are even more effective. A more effective polymer is one which can be used in smaller quantities than polyvinyl pyrollidone to achieve the same effect, and which is cheaper.

In today's granular detergent market it is particularly important to find an efficient dye transfer inhibition polymer (or a mixture of polymers) which can be easily handled as a high bulk density granule, and which can be added in small amounts to compact products and which does not have an adverse effect on product dispensing.

The present invention provides a high density agglomerate which comprises copolymers of N-vinylpyrrolidone and N-vinylimidazole, typically at levels of 5% to 50% by weight.

The present invention also provides a process in which a premix of specific hygroscopic dye transfer inhibition polymer with zeolite (or other powder) is prepared prior to agglomeration.

SUMMARY OF THE INVENTION

In a first aspect, the present invention provides a free-flowing powder having a bulk density of at least 600 g/l comprising:

(a) from 20% to 95% by weight (on anhydrous basis) of a detergent ingredient selected from the group consisting of aluminosilicate, citrate, silica, carbonate, bicarbonate, silicate, sulphate, phosphate, water-soluble polymer and mixtures thereof; and (b) from 5% to 50% by weight of a copolymer of N-vinylpyrrolidone and N-vinylimidazole.

Whilst the free-flowing powder may comprise other components it is preferred that the level of surfactant is than 2% by weight of the powder.

Preferably the free-flowing powder comprises (a) from 50% to 75% by weight (on anhydrous basis) of aluminosilicate and (b) a mixture of polyamine N-oxide and copolymer of N-vinylpyrrolidone and N-vinylimidazole, the total polymer level being from 10% to 30% by weight of the powder.

The mixture of polyamine N-oxide and copolymers of N-vinylpyrrolidone and N-vinylimidazole is typically in the weight ratio of from 5:1 to 1:5, and is preferably about 1:1.

In a second aspect the present invention provides a process for making free-flowing particles comprising hygroscopic powders of polymers comprising the steps of:

(a) mixing a powder comprising polyamine N-oxide and/or copolymers of N-vinylpyrrolidone and N-vinylimidazole with additional powders, the additional powders being selected from the group consisting of aluminosilicate, citrate, silica, carbonate, bicarbonate, silicate, sulphate, phosphate, water-soluble polymer and mixtures thereof, to form a powder premix; and (b) mixing the premix with an aqueous binder in a high shear mixer to form free-flowing particles.

The aqueous binder in step (b) is preferably an aqueous solution of polyamine N-oxide.

A preferred process comprises the steps of (a) mixing from 5% to 25% by weight of a powdered copolymer of N-vinylpyrrolidone and N-vinylimidazole with from 50% to 75% by weight (on anhydrous basis) of sodium aluminosilicate to form a premix, and (b) mixing the premix with from 5% to 25% by weight (on active basis) of an aqueous solution of polyamine N-oxide in a high shear mixer to form free-flowing particles.

Optionally, the step of (c) drying the mixture of the premix and aqueous solution of binder to form the free-flowing particles may also be included in the process.

The aluminosilicate, and any other salt present is usually fully hydrated prior to the high shear mixer.

DETAILED DESCRIPTION OF THE INVENTION

All of the percentages herein are by weight of the free-flowing powder unless otherwise stated.

An essential ingredient of the free-flowing powders of the present invention is a polymeric dye transfer inhibiting agent. Polymeric dye transfer inhibiting agents are normally incorporated into detergent compositions in order to inhibit the transfer of dyes from colored fabrics onto fabrics washed therewith. These polymers have the ability to complex or adsorb the fugitive dyes washed out of dyed fabrics before the dyes have the opportunity to become attached to other articles in the wash.

Especially suitable polymeric dye transfer inhibiting agents are polyamine N-oxide polymers, copolymers of N-vinylpyrrolidone and N-vinylimidazole, polyvinylpyrrolidone polymers, polyvinyloxazolidones and polyvinylimidazoles or mixtures thereof.

a) Polyamine N-oxide polymers

The polyamine N-oxide polymers suitable for use contain units having the following structure formula:

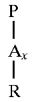

(I)

wherein P is a polymerisable unit, whereto the R—N—O group can be attached to or wherein the R—N—O group forms part of the polymerisable unit or a combination of both.

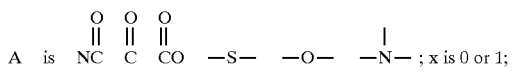

A is NC, C, CO, —S—, —O—, —N— ; x is 0 or 1;

R are aliphatic, ethoxylated aliphatics, aromatic, heterocyclic or alicyclic groups or any combination thereof whereto the nitrogen of the N—O group can be attached or wherein the nitrogen of the N—O group is part of these groups.

The N—O group can be represented by the following general structures:

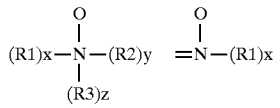

wherein R1, R2, and R3 are aliphatic groups, aromatic, heterocyclic or alicyclic groups or combinations thereof, x or/and y or/and z is 0 or 1 and wherein the nitrogen of the N—O group can be attached or wherein the nitrogen of the N—O group forms part of these groups.

The N—O group can be part of the polymerisable unit (P) or can be attached to the polymeric backbone or a combination of both.

Suitable polyamine N-oxides wherein the N—O group forms part of the polymerisable unit comprise polyamine N-oxides wherein R is selected from aliphatic, aromatic, alicyclic or heterocyclic groups.

One class of said polyamine N-oxides comprises the group of polyamine N-oxides wherein the nitrogen of the N—O group forms part of the R-group. Preferred polyamine N-oxides are those wherein R is a heterocyclic group such as pyrridine, pyrrole, imidazole, pyrrolidine, piperidine, quinoline, acridine and derivatives thereof.

Another class of said polyamine N-oxides comprises the group of polyamine N-oxides wherein the nitrogen of the N—O group is attached to the R-group.

Other suitable polyamine N-oxides are the polyamine oxides whereto the N—O group is attached to the polymerisable unit.

Preferred class of these polyamine N-oxides are the polyamine N-oxides having the general formula (I) wherein R is an aromatic, heterocyclic or alicyclic groups wherein the nitrogen of the N—O functional group is part of said R group.

Examples of these classes are polyamine oxides wherein R is a heterocyclic compound such as pyrridine, pyrrole, imidazole and derivatives thereof.

Another preferred class of polyamine N-oxides are the polyamine oxides having the general formula (I) wherein R are aromatic, heterocyclic or alicyclic groups wherein the nitrogen of the N—O functional group is attached to said R groups.

Examples of these classes are polyamine oxides wherein R groups can be aromatic such as phenyl.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof.

The amine N-oxide polymers of the present invention typically have a ratio of amine to the amine N-oxide of 10:1 to 1:1000000. However the amount of amine oxide groups present in the polyamine oxide polymer can be varied by appropriate copolymerization or by appropriate degree of N-oxidation. Preferably, the ratio of amine to amine N-oxide is from 2:3 to 1:1000000. More preferably from 1:4 to 1:1000000, most preferably from 1:7 to 1:1000000. The polymers of the present invention actually encompass random or block copolymers where one monomer type is an amine N-oxide and the other monomer type is either an amine N-oxide or not. The amine oxide unit of the polyamine N-oxides has a PKa<10, preferably PKa<7, more preferred PKa<6.

The polyamine oxides can be obtained in almost any degree of polymerisation. The degree of polymerisation is not critical provided the material has the desired water-solubility and dye-suspending power.

Typically, the average molecular weight is within the range of 500 to 1000,000; preferably from 1,000 to 50,000, more preferably from 2,000 to 30,000, most preferably from 3,000 to 20,000.

b) Copolymers of N-vinylpyrrolidone and N-vinylimidazole

The N-vinylimidazole N-vinylpyrrolidone polymers used in the present invention have an average molecular weight range from 5,000–1,000,000, preferably from 20,000–200,000.

Highly preferred polymers for use in detergent compositions according to the present invention comprise a polymer selected from N-vinylimidazole N-vinylpyrrolidone copolymers wherein said polymer has an average molecular weight range from 5,000 to 50,000 more preferably from 8,000 to 30,000, most preferably from 10,000 to 20,000. The average molecular weight range was determined by light scattering as described in Barth H. G. and Mays J. W. Chemical Analysis Vol 113, "Modern Methods of Polymer Characterization".

Highly preferred N-vinylimidazole N-vinylpyrrolidone copolymers have an average molecular weight range from 5,000 to 50,000; more preferably from 8,000 to 30,000; most preferably from 10,000 to 20,000.

The N-vinylimidazole N-vinylpyrrolidone copolymers characterized by having said average molecular weight range provide excellent dye transfer inhibiting properties while not adversely affecting the cleaning performance of detergent compositions formulated therewith.

The N-vinylimidazole N-vinylpyrrolidone copolymer of the present invention has a molar ratio of N-vinylimidazole to N-vinylpyrrolidone from 1 to 0.2, more preferably from 0.8 to 0.3, most preferably from 0.6 to 0.4.

c) Polyvinylpyrrolidone

The detergent compositions of the present invention may also utilize polyvinylpyrrolidone ("PVP" having an average molecular weight of from about 2,500 to about 400,000, preferably from about 5,000 to about 200,000, more preferably from about 5,000 to about 50,000, and most preferably from about 5,000 to about 15,000. Suitable polyvinylpyrrolidones are commercially available from ISP Corporation, New York, N.Y. and Montreal, Canada under the product names PVP K-15 (viscosity molecular weight of 10,000), PVP K-30 (average molecular weight of 40,000), PVP K-60 (average molecular weight of 160,000), and PVP K-90 (average molecular weight of 360,000). PVP K-15 is also available from ISP Corporation. Other suitable polyvinylpyrrolidones which are commercially available from BASF Cooperation include Sokalan HP 165 and Sokalan HP 12. Polyvinylpyrrolidones known to persons skilled in the detergent field; see for example EP-A-262,897 and EP-A-256,696.

d) Polyvinyloxazolidone

The detergent compositions of the present invention may also utilize polyvinyloxazolidone as a polymeric dye transfer inhibiting agent. Said polyvinyloxazolidones have an average molecular weight of from about 2,500 to about 400,000, preferably from about 5,000 to about 200,000, more preferably from about 5,000 to about 50,000, and most preferably from about 5,000 to about 15,000.

e) Polyvinylimidazole

The detergent compositions of the present invention may also utilize polyvinylimidazole as polymeric dye transfer inhibiting agent. Said polyvinylimidazoles have an average about 2,500 to about 400,000, preferably from about 5,000 to about 200,000, more preferably from about 5,000 to about 50,000, and most preferably from about 5,000 to about 15,000.

A highly preferred component of the free-flowing powders of the present invention is aluminosilicate.

Sodium aluminosilicate may take many forms. One example is crystalline aluminosilicate ion exchange material of the formula $$Na_z[(AlO_2)_z.(SiO_2)_y].xH_2O$$

wherein z and y are at least about 6, the molar ratio of z to y is from about 1.0 to about 0.4 and z is from about 10 to about 264. Amorphous hydrated aluminosilicate materials useful herein have the empirical formula $$M_z(zAlO_2.ySiO_2)$$

wherein M is sodium, potassium, ammonium or substituted ammonium, z is from about 0.5 to about 2 and y is 1, said material having a magnesium ion exchange capacity of at least about 50 milligram equivalents of $CaCO_3$ hardness per gram of anhydrous aluminosilicate. Hydrated sodium Zeolite A with a particle size of from about 1 to 10 microns is preferred.

The aluminosilicate ion exchange builder materials herein are in hydrated form and contain from about 5% to about 28% of water by weight if crystalline, and potentially even higher amounts of water if amorphous. Highly preferred crystalline aluminosilicate ion exchange materials contain from about 15% to about 22% water in their crystal matrix. The crystalline aluminosilicate ion exchange materials are further characterized by a particle size diameter of from about 0.1 micron to about 10 microns. Amorphous materials are often smaller, e.g., down to less than about 0.01 micron. Preferred ion exchange materials have a particle size diameter of from about 0.2 micron to about 4 microns. The term "particle size diameter" herein represents the average particle size diameter by weight of a given ion exchange material as determined by conventional analytical techniques such as, for example, microscopic determination utilizing a scanning electron microscope. The crystalline aluminosilicate ion exchange materials herein are usually further characterized by their calcium ion exchange capacity, which is at least about 200 mg equivalent of $CaCO_3$ water hardness/g of aluminosilicate, calculated on an anhydrous basis, and which generally is in the range of from about 300 mg eq./g to about 352 mg eq./g. The aluminosilicate ion exchange materials herein are still further characterized by their calcium ion exchange rate which is at least about 2 grains $Ca^{++}$/gallon/minute/gram/gallon of aluminosilicate (anhydrous basis), and generally lies within the range of from about 2 grains/gallon/minute/gram/gallon to about 6 grains/gallon/minute/gram/gallon, based on calcium ion hardness. Optimum aluminosilicate for builder purposes exhibit a calcium ion exchange rate of at least about 4 grains/gallon/minute/gram/gallon.

The amorphous aluminosilicate ion exchange materials usually have a $Mg^{++}$ exchange of at least about 50 mg eq. $CaCO_3$/g (12 mg $Mg^{++}$/g) and a $Mg^{++}$ exchange rate of at least about 1 grain/gallon/minute/gram/gallon. Amorphous materials do not exhibit an observable diffraction pattern when examined by Cu radiation (1.54 Angstrom Units).

Aluminosilicate ion exchange materials useful in the practice of this invention are commercially available. The aluminosilicates useful in this invention can be crystalline or amorphous in structure and can be naturally occurring aluminosilicates or synthetically derived. A method for producing aluminosilicate ion exchange materials is discussed in U.S. Pat. No. 3,985,669, Krummel et al., issued Oct. 12, 1976, incorporated herein by reference. Preferred synthetic crystalline aluminosilicate ion exchange materials useful herein are available under the designations Zeolite A, Zeolite B, Zeolite MAP and Zeolite X. In an especially preferred embodiment, the crystalline aluminosilicate ion exchange material has the formula $$Na_{12}[(AlO_2)_{12}(SiO2)_{12}].xH_2O$$

wherein x is from about 20 to about 30, especially about 27 and has a particle size generally less than about 5 microns.

The aluminosilicate of the present invention may, optionally, be fully or partially replaced by other particulate materials such as citrate, silicate, carbonate, bicarbonate, sulphate, phosphate, silica and mixtures thereof.

Water soluble polymers, in addition to the polymeric dye transfer inhibiting agents listed above may be incorporated into the free-flowing powders of the present invention. Typical examples of such polymers are sodium carboxy-lower alkyl celluloses, sodium lower alkyl celluloses and sodium hydroxy-lower alkyl celluloses, such as sodium carboxymethyl cellulose, sodium methyl cellulose and sodium hydroxypropyl cellulose, polyvinyl alcohols (which often also include some polyvinyl acetate), polyacrylamides, polyacrylates and various copolymers, such as those of maleic and acrylic acids. Molecular weights for such polymers vary widely but most are within the range of 2,000 to 100,000.

Polymeric polycarboxylate builders are set forth in U.S. Pat. No. 3,308,067, Diehl, issued Mar. 7, 1967. Such materials include the water-soluble salts of homo- and copolymers of aliphatic carboxylic acids such as maleic acid, itaconic acid, mesaconic acid, fumaric acid, aconitic acid, citraconic acid and methylenemalonic acid.

It is preferred that the free-flowing powders of the present invention comprise less than 2% by weight of surfactants, and preferably do not contain any surfactants. However, where surfactants are incorporated, anionic, nonionic, cationic, amphoteric, and zwitterionic surfactants may be used.

PROCESS

The preferred process of the present invention comprising the steps of:

(a) mixing a powder comprising copolymers of N-vinylpyrrolidone and N-vinylimidazole with additional powders, to form a powder premix; and (b) mixing the premix with an aqueous binder in a high shear mixer to form free-flowing particles.

The aqueous binder in step (b) is preferably an aqueous solution of a polyamine N-oxide polymer, preferably poly (4-vinyl pyridine N-oxide).

High shear mixers suitable for use in the present invention include the Fukae® FS-G series manufactured by Fukae Powtech Kogyo Co., Japan; this apparatus is essentially in the form of a bowl-shaped vessel accessible via a top port, provided near its base with a stirrer having a substantially vertical axis, and a cutter positioned on a side wall. The stirrer and cutter may be operated independently of one another and at separately variable speeds. The vessel can be fitted with a cooling jacket or, if necessary, a cryogenic unit.

Other similar mixers found to be suitable for use in the process of the invention include Diosna® V series ex Dierks & Söhne, Germany; and the Pharma Matrix® ex T K Fielder Ltd., England. Other mixers believed to be suitable for use in the process of the invention are the Fuji® VG-C series ex Fuji Sangyo Co., Japan; and the Roto® ex Zanchetta & Co srl, Italy.

Other preferred suitable equipment can include Eirich®, series RV, manufactured by Gustau Eirich Hardheim, Germany; Lödige®, series FM for batch mixing, series Baud KM for continuous mixing/agglomeration, manufactured by Lödige Machinenbau GmbH, Paderborn Germany; Drais® T160 series, manufactured by Drais Werke GmbH, Mannheim Germany; and Winkworth® RT 25 series, manufactured by Winkworth Machinery Ltd., Berkshire, England. A particularly preferred combination of mixers is a Lödige® CB mixer, followed in series by a Lödige® KM mixer.

The Littleford Mixer, Model #FM-130-D-12, with internal chopping blades and the Cuisinart Food Processor, Model #DCX-Plus, with 7.75 inch (19.7 cm) blades are two examples of suitable mixers. Any other mixer with fine dispersion mixing and granulation capability and having a residence time in the order of 0.1 to 10 minutes can be used. The "turbine-type" impeller mixer, having several blades on an axis of rotation, is preferred. The invention can be practiced as a batch or a continuous process.

After the mixing step, an additional drying step may be employed. A continuous fluidised bed dryer is suitable for this.

The particle size of the free-flowing particles of the present invention may also be important, particularly with regard to the tendency to form gel upon contact with water which has an adverse effect upon product dispensing. It is preferred that small particles, especially "fines" are avoided. Preferably the mean particle size is greater than 300 micrometers, preferably greater than 450 micrometers, and most preferably about 550 micrometers. Average particle size may be conveniently calculated by splitting the product into a series of fractions on a series of sieves of decreasing mesh aperture, and measuring the weight of each fraction.

Finished Product Compositions

It is expected that the free-flowing particles of the present invention will be added to other granular components to give a finished product composition. Other granular components may be prepared by any suitable means including spray drying, spray cooling, and agglomeration. Compact detergent compositions (i.e. those having a bulk density of at least 600 g/l) according to the present invention typically comprise from 0.001% to 10%, preferably from 0.01% to 2%, more preferably from 0.05% to 1% by weight of a polymeric dye transfer inhibiting agents.

Bulk density

All the bulk densities referred to herein are measured by the non-compacted repour cup density method. This method uses an apparatus consisting of a funnel mounted above a 500 ml cup, the distance from the base of the funnel to the top of the cup being 50 mm. The cup is filled to overflowing with product from the funnel (through an aperture of 40 mm diameter). Without tapping the cup, excess product is removed by scraping away excess by means of a straight edge across the top of the cup. The net weight of product is then measured and recorded, and bulk density is calculated according to the volume of the cup.

EXAMPLES

In the examples the following abbreviations have been used:

| | |
|---|---|
| PVPVI | Copolymers of N-vinylpyrrolidone and N-vinylimidazole having a molecular weight of 10000. |
| PVNO | Poly (4-vinyl pyridine N-oxide) having a molecular weight of 10000. |

Example 1

The following premix was prepared in a batch vertomix blender:

| | |
|---|---|
| Zeolite 4A | 80 parts by weight |
| PVPVI | 10.5 parts by weight |

The premix was transferred on a continuous basis by means of a feeding screw to the inlet port of a Loedige® CB high shear mixer operated at 1700 rpm. An aqueous solution of PVNO (having an active content of 35%) was pumped to spray nozzles in the mixer. At the same time water was pumped to additional spray nozzles in the mixer. The components being added in the following ratio:

| | |
|---|---|
| Premix | 90.5 parts by weight |
| PVNO Solution | 30 parts by weight |
| Water | 8 parts by weight |

The wet powder at the exit port of the high shear mixer was transferred directly into the inlet port of a Loedige® KM mixer operating at 140 rpm.

Further agglomeration of the wet powder took place in the second mixer to form a wet agglomerate. With the exit gate of the second mixer fully open, wet agglomerates were transferred by a vibrating tube into a continuous fluidised bed supplied with air at 120° C.

The resulting free-flowing powder had a bulk density of 700 g/l and a composition of:

| | |
|---|---|
| Zeolite (anhydrous basis) | 65% |
| PVPVI | 10.5% |
| PVNO | 10.5% |
| Water | 9% |
| Miscellaneous* | 5% |

(*miscellaneous are principally impurities brought into the process with the zeolite).

Example 2

The process of example 1 was repeated except the premix was prepared in a continuous ribbon blender, and subsequently conveyed to the inlet of the Loedige® CB mixer using a pneumatic conveying system, and a feeding screw. The Loedige® CB mixer was operated at 1000 rpm.

Example 3

The process of example 1 was repeated with a 10 cm weir in the fluidised bed. The weir had the effect of increasing the residence time in the fluidised bed to 5 to 10 minutes.

Example 4

The premix of example 1 was prepared in a high shear Eirich® mixer. The PVNO solution was then added directly to the Eirich® mixer resulting in agglomeration of the premix to form wet granules. The granules were then transferred to a batch fluidised bed supplied with air at 100° C. and dried.

What is claimed is:

1. A free-flowing powder detergent additive having a bulk density of at least 600 g/l consisting essentially of:

(a) from 20% to 95% by weight, on anhydrous basis, of a detergent ingredient selected from the group consisting of aluminosilicate, citrate, silica, carbonate, bicarbonate, silicate, sulphate, phosphate, water-soluble polymer and mixtures thereof; and (b) from 5% to 50% by weight of a polymeric dye transfer inhibitor selected from the group consisting of polyamine N-oxide polymers, copolymers of N-vinylpyrrolidone and N-vinylimidazole and mixtures thereof.

2. A free-flowing powder detergent additive according to claim 1 consisting essentially of:

(a) from 50% to 75% by weight, on anhydrous basis, of aluminosilicate; and (b) from 10% to 30% by weight of a polymeric dye transfer inhibiting agent selected from the group consisting of polyamine N-oxide polymers, and copolymers of N-vinylpyrrolidone and N-vinylimidazole and mixtures thereof.

3. A free-flowing powder detergent additive according to claim 2 consisting essentially of a mixture of polyamine N-oxide (i) and copolymers of N-vinylpyrrolidone and N-vinylimidazole (ii) wherein the ratio weight of (i) to (ii) is from 5:1 to 1:5.

4. A free-flowing powder detergent additive according to claim 3 wherein the weight ratio of (i) to (ii) is from 5:1 to 1:1.

5. A process for making free-flowing particles comprising hygroscopic powders of polymers comprising the steps of:

(a) mixing a powdered polymer selected from the group consisting of polyamine N-oxide polymers, copolymers of N-vinylpyrrolidone and N-vinylimidazole, and mixtures thereof, with additional powders to form a powder premix, where the additional powders are selected from the group consisting of aluminosilicate, citrate, silica, carbonate, bicarbonate, silicate, sulphate, phosphate, water-soluble polymer and mixtures thereof; and (b) mixing the powder premix with an aqueous solution of polyamine N-oxide in a high shear mixer to form free-flowing particles.

6. A process according to claim 5 comprising the steps of:

(a) mixing from 5% to 25% by weight of a powdered copolymer of N-vinylpyrrolidone and N-vinylimidazole with from 50% to 75% by weight, on anhydrous basis, of sodium aluminosilicate to form a powder premix; and (b) mixing the powder premix with from 5% to 25% by weight, on active basis, of polyamine N-oxide in a high shear mixer to form free-flowing particles.

7. A process according to claim 6, further comprising the step of (c) drying the mixture of the premix and aqueous solution of binder to form the free-flowing particles.

* * * * *